US005263502A

United States Patent [19]

Dick

[11] Patent Number: 5,263,502

[45] Date of Patent: Nov. 23, 1993

[54] INLET VALVE ASSEMBLY

[76] Inventor: Jack Dick, 20 Hunters Trail, Warren, N.J. 07059

[21] Appl. No.: 909,574

[22] Filed: Jul. 6, 1992

[51] Int. Cl.[5] ..... F16L 5/00

[52] U.S. Cl. ..... 137/360; 137/15

[58] Field of Search ..... 137/15, 360

[56] References Cited

U.S. PATENT DOCUMENTS

| | | | |
|---|---|---|---|
| 3,036,814 | 5/1962 | Stevens | 137/360 |
| 3,283,093 | 11/1966 | Bishop | 137/360 |
| 3,291,927 | 12/1966 | Riley, Jr. et al. | 137/360 |
| 3,335,744 | 8/1967 | Honford | 137/360 |
| 3,565,103 | 2/1971 | Maselek | 137/360 |

*Primary Examiner*—A. Michael Chambers
*Attorney, Agent, or Firm*—Thomas L. Adams

[57] ABSTRACT

An inlet valve assembly for a central vacuum system is installed in a wall or floor having a front side, a backside and a mounting hole extending therethrough. This inlet valve assembly includes a front mounting plate having an inlet tube. The assembly also has an annular brace adapted to slidably mount on the inlet tube and sized to fit through the mounting hole. The assembly also has a plurality of clamping arms pivotally mounted on the brace. These arms can swing from a retracted position alongside the brace to an extended position at the backside.

47 Claims, 5 Drawing Sheets 4
4
22
23
22
22A
12
14
18A
36
34
20
66
16
10
31
15A
18B
26A
24
22
24A
22A
22
30
64
26
28

FIG. 6
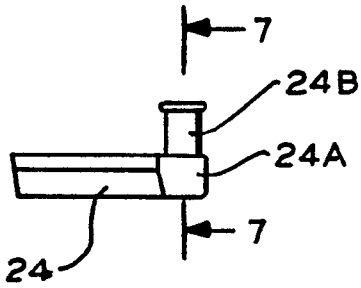
FIG. 7
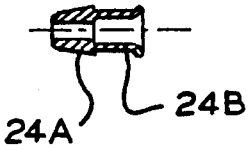
FIG. 8
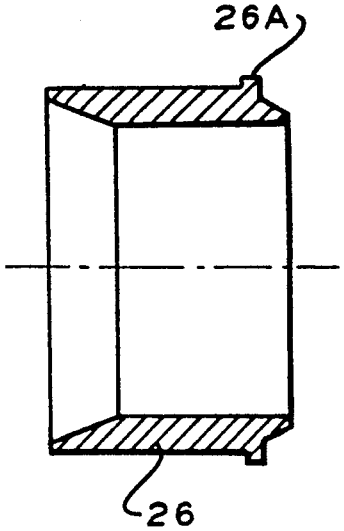
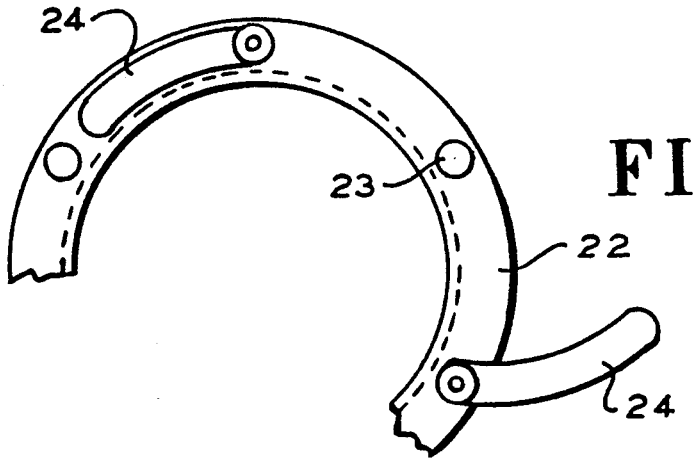
FIG. 5
FIG. 11
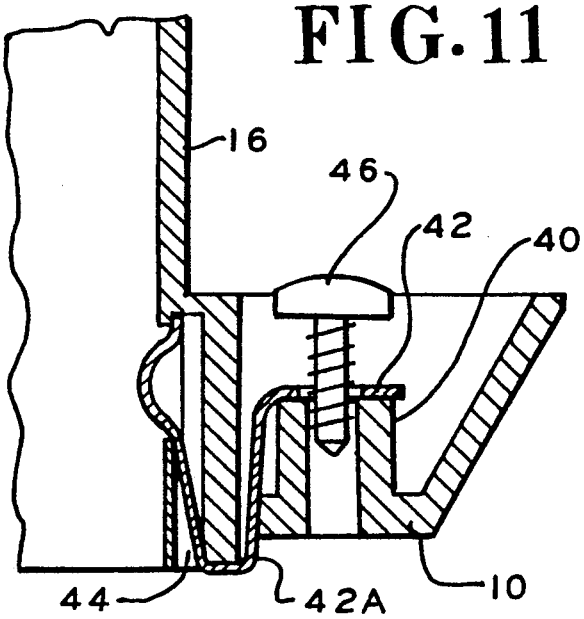

INLET VALVE ASSEMBLY

BACKGROUND OF THE INVENTION

The present invention relates to an inlet valve assembly for a central vacuum system and, in particular, to a mechanism for securing the valve assembly to a wall or floor.

Central vacuum systems may be installed in new construction or in existing houses. Such systems have a number of inlet valves mounted throughout the house on various walls and floors. Each of these inlet valves connect to a central vacuum by means of a network of pipes or hoses.

The inlet valves often consist of (1) a face plate with a door and an inlet tube, and (2) a rear backer plate carrying a larger adaptor tube that telescopically fits around the inlet tube in the face plate. A system connection can be made to the tube on the backer plate. For examples of inlet valves see U.S. Pat. Nos. 2,851,286; 3,088,484; 4,688,596; and 4,758,170.

In new construction the rear backer plate is often mounted on a stud and then a matching hole is cut in the dry wall about to be installed. After the dry wall is installed, the front face plate can be mounted over the hole in alignment with the backer plate.

When installing a valve in existing homes, the backer plate is normally not attached to a stud. Instead, the installer relies on the fact that the backer plate is larger than the hole made in the wall or floor for the valve. After cutting this hole the installer will insert the shorter end of the backer plate edgewise into the hole. Once past the dry wall, the backer plate is turned by hand so it lies flat against the backside of the dry wall. Typically then, a hook or other fixture is used to hold the backer plate in position, while the front plate is then slipped over the outside end of the hook to lie against the outside of the wall in line with the backer plate. Holding the hook with one hand, the installer must now drive screws through the face plate, the dry wall and into the backer plate. This operation obviously requires much manual dexterity and the difficulty in aligning the face plate and backer plate is apparent.

Regardless of the care taken by the installer, the face plates of these known valves often do not have a visually "correct" alignment with the room structure. Before insertion into a wall, the backer plate's tube usually has glued to it a fitting such as an elbow. Being glued first, the elbow and therefore the backer plate and face plate will have a strictly defined orientation to the pipe that will eventually connect to the elbow. Since the face plate is committed to a particular orientation, it cannot be later readjusted to compensate for small misalignments. Virtual misalignments may also occur when the floor and walls are not plumb and square. Thus a face plate may be truly vertical but appear tilted because the wall or floor is not true. The need for such offsetting adjustments are extremely difficult to anticipate before the face plate is in place, after which readjustment is impossible with conventional valves.

Another disadvantage with known inlet valves is the fact that the junction between the tubes of the face plate and backer plate is discontinuous, thereby creating turbulence and an opportunity for clogging. Also, the joint between these tubes normally employs an O-ring that can leak as the ring drys over time.

Conventional valves are also unable to accommodate the great variety of types of central vacuum systems.

One common central vacuum system employs a pair of low voltage, metal contacts that protrude into the cylindrical inlet of the valve. The insertion into the inlet valve of the metal fitting of a vacuum hose shorts those contacts to start the central vacuum pump. Alternatively, the hose coupling may have semi-cylindrical conductive halves that separately connect to the valve contacts and to a remote switch at the operating end of the hose, so the vacuum system can be turned on and off remotely. Other types of vacuum systems supply a higher voltage to a receptacle on the face plate so that a separate electrical plug on the proximal end of the hose can power equipment such as a rug beater at the remote end of the hose. To accommodate different system types, known valves have used a knockout plate for optional installation of such a receptacle.

Some systems provide low voltage, door switches to start the vacuum system. Some of these systems will positively start the central vacuum, even in the absence of an inserted hose, when the door is opened to an extreme position. Other systems start the vacuum as soon as the door is opened even slightly. Still other valves use a higher voltage microswitch that is activated either when the valve door is lifted, or upon the insertion of a hose.

Known valves have been dedicated to one of the foregoing system types. No known valves, however, have been able to accommodate a significant number of the varieties of systems. Accordingly, an installer must carry a large inventory of valves in order to install the various types of systems requested by homeowners.

Known electrical outlet boxes have wings or tabs that are initially stowed close to the box so they can be inserted into a dry wall. Once inserted, the wings or tabs are rotated by screws through a plane parallel to the dry wall, from a position alongside the box to a position extending behind the dry wall. After such extension, the screws can be tightened to press the wing or tab against the back of the dry wall. See for example U.S. Pat. Nos. 2,320,400; and 2,801,019. See also U.S. Pat. No. 3,018,082, showing a bracket arm rotating about an axis perpendicular to a ceiling for mounting a light fixture.

Other electrical boxes have wings or tabs that are located inside the electrical box and are rotated out of the box and behind the dry wall, all for similar purposes. See for example U.S. Pat. Nos. 2,031,861; 2,413,139; and 2,875,914. Still other electrical boxes use flaps that fold flat against the electrical box but unfold when pushed past the dry wall. These flaps rotate on an axis that is parallel to the dry wall. See, for example, U.S. Pat. Nos. 1,775,665; and 1,957,003. See also U.S. Pat. Nos. 4,304,958; and 4,332,330.

In U.S. Pat. No. 3,322,442 a cylindrical insert is connected to a duct by inserting its lower collar into a circular opening in the duct. A ledge on the insert keeps it from falling into the duct. Clamps are then rotated from a position inside the cylindrical insert to a position outside, to clamp the cylindrical insert onto the duct wall. See also U.S. Pat. No. 4,023,833.

SUMMARY OF THE INVENTION

In accordance with the illustrative embodiment demonstrating features and advantages of the present invention, there is provided an inlet valve assembly for a central vacuum system to be installed in a wall or floor having a front side, a backside and a mounting hole extending therethrough. This inlet valve assembly has a front mounting plate with an inlet tube. The assembly also has an annular brace adapted to slidably mount on the inlet tube and sized to fit through the mounting hole. Also included is a plurality of clamping arms pivotally mounted on the brace. These arms are operable to swing from a retracted position alongside the brace into an extended position at the backside.

In accordance with another embodiment of the same invention, an inlet valve assembly for a central vacuum system can be installed in such a wall or floor. The inlet valve assembly has a front mounting plate having an inlet tube. The assembly has a door pivotally mounted on the front mounting plate to cover the inlet tube. The front mounting plate (1) is adapted to receive any one of the following options, and (2) includes and is fitted with one or more of the following options: (a) a switch mounted on the rear of the front mounting plate to engage and be actuated by motion of the door, and (b) a circumferentially spaced pair of tube contacts mounted on the rear of the front mounting plate to project from outside to inside the inlet tube.

In accordance with a related method of the same invention, an inlet valve for a central vacuum system can be installed in a wall or floor having a front side or a back side. The method employs a front mounting plate with an inlet tube and an annular brace with a plurality of clamping arms. The method includes the step of cutting a mounting hole through the wall or floor. Another step is positioning the annular brace at the backside and the front mounting plate at the front side in alignment with the mounting hole. Another step in the method is securing the front mounting plate and the annular brace to the wall or floor by swinging the clamping arms from a retracted position alongside the brace to an extended position at the backside.

A related method of the same invention acts with the same wall or floor and the same inlet valve, except the front mounting plate now has a door as well as an inlet tube. After cutting a mounting hole as before, the front mounting plate is adapted in the field to enable one or more of the following options: (a) enabling a switch on the front mounting plate that can engage and be actuated by motion of the door: (b) enabling a circumferentially spaced pair of tube contacts that project inside the inlet tube.

By employing apparatus and methods of the foregoing type, a relatively simple inlet valve assembly can be adapted to various systems and efficiently installed. In a preferred assembly, a front plate has a door that closes over an inlet tube. This inlet tube preferably fits telescopically into an adaptor tube that rotatably supports an annular brace. This annular brace supports a number of separate swinging arms.

The valve assembly can be assembled by placing the adaptor tube and the annular brace on the inlet tube prior to installation. At this time, screws can be connected between the front plate and the swinging arms, but the swinging arms kept in a retracted position alongside the annular brace The valve assembly is then simply inserted into a circular hole cut in a floor or wall and by tightening the screws, the swinging arms extend out to hold the inlet valve assembly in place.

This highly efficient technique avoids the need of separately handling a front plate and back plate and holding the back plate in position with a special hook or fixture. Also, since the adaptor tube is rotatably connected to the annular brace and the front plate, the latter can rotate relative to the adaptor tube so that visual adjustments can be made after installation.

Also the preferred adaptor tube has tapered ends that provide a smooth transition between it the inlet tube and the system pipes. The adaptor tube can be also made of a resilient material to avoid the need for an O-ring, but still maintain a good seal.

In a preferred embodiment, the front plate can support optional features Preferably, the plate can be adapted to activate the central vacuum system either: when the door is initially opened; when the door is opened fully; when a hose is inserted into the valve; or when a remote switch on the hose is actuated. These various features can be accomplished either by mounting various microswitches or cantilevered contacts on the back of the front plate. The cantilevered contacts can be actuated by the door and can use the hinge spring of the door as part of the switching circuit. The microswitch can sense the insertion of a hose or the motion of the valve door. Accordingly, the preferred inlet valve assembly can operate under one or more of various functional regimes.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention taken in conjunction with the accompanying drawings wherein;

FIG. 5 is a partial front view of the brace of FIG. 3 shown with arms installed;

FIG. 6 is a side view of one of the arms of FIG. 5;

FIG. 7 is a cross sectional view taken along line 7—7 of FIG. 6 showing the collar;

FIG. 8 is a cross sectional view of the adaptor tube of FIG. 2;

FIG. 11 is a detailed, cross sectional view of the front mounting plate and hardware, taken along line 11—11 of FIG. 9;

DETAILED DESCRIPTION OF THE PREFERRED EMBODIMENT

Figure 1:
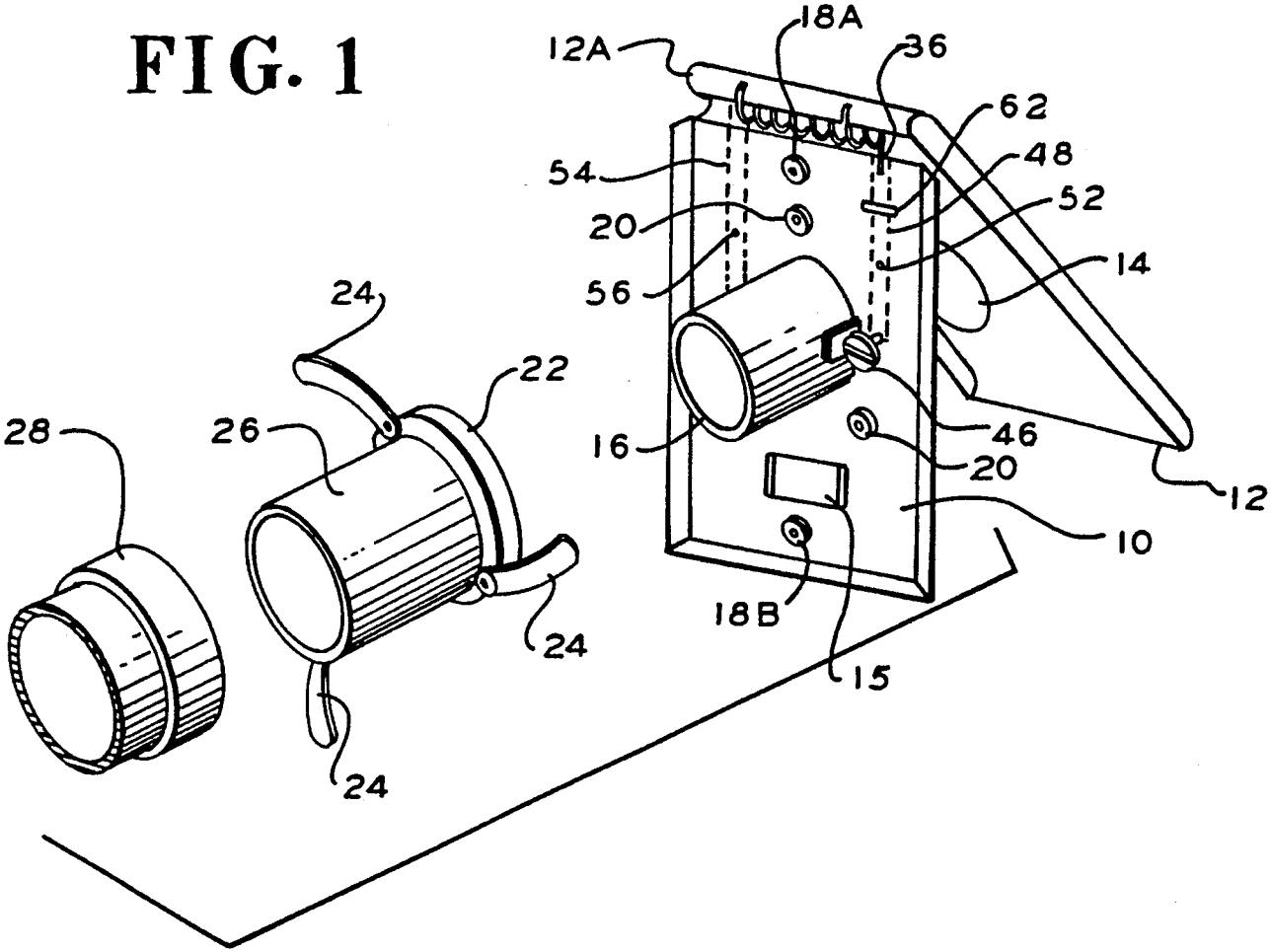
FIG. 1 is an exploded perspective view of an inlet valve assembly in accordance with the principles of the present invention.

Referring to FIG. 1; an inlet valve assembly is shown employing a front mounting plate 10 having a bevelled skirt along its side and bottom. Hinged to the top edge of plate 10 is door 12. Door 12 is a generally flat member having short perpendicular side pieces and two rounded ends. Plate 10 has a knock out panel 15 that is readily removed to allow installation of a receptacle for powering an accessory with house current. Plate 10 and door 12 can be made of various types of plastic although other materials can be used as well.

Door 12 has a resilient gasket 14 that presses against the face of mounting plate 10 to cover the front opening of inlet tube 16. Tube 16 is a cylindrical sleeve communicating through the front of plate 10. Plate 10 has a pair of screw holes 18A and 18B used for mounting in new construction in a manner described hereinafter. Plate 10 also has a trio of equiangularly spaced screw holes 20 (only two visible in this view). Screw holes 20 align with holes in annular brace 22.

Annular brace 22 is shown as a circular annulus having three clamping arms 24 rotatably mounted at equiangularly spaced positions. Rotatably and coaxially mounted within brace 22 is an adaptor tube 26. Tube 26 is sized to telescopically and sealingly fit over inlet tube 16. Tube 26 is sized to fit into a another fitting such as elbow 28.

Figures 2, 3, 4:
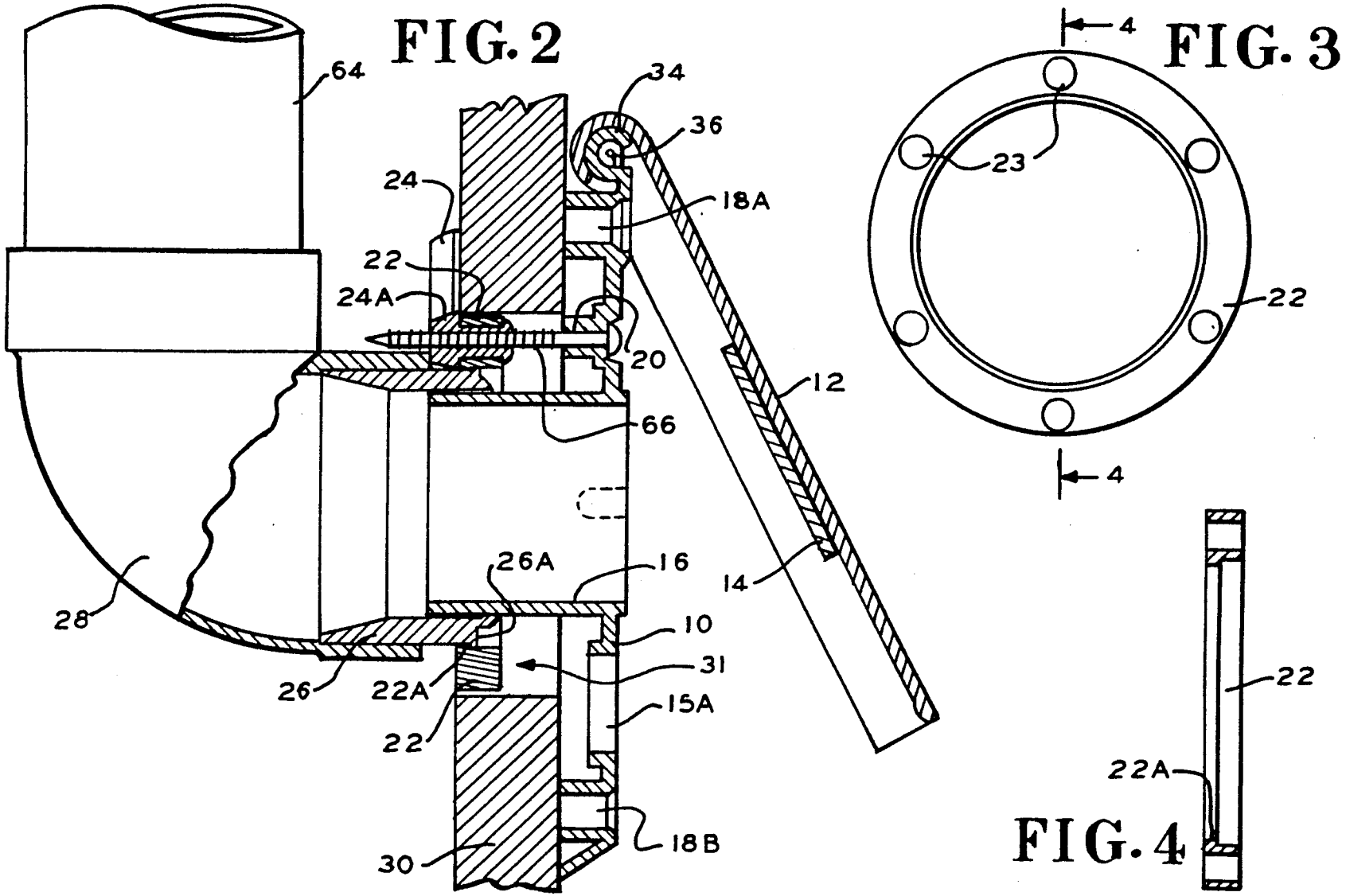
FIG. 2 is a side view, partially in section, of the inlet valve assembly of FIG. 1.
FIG. 3 is a front view of the annular brace of FIG. 2.
FIG. 4 is a cross sectional view taken along line 4—4 of FIG. 3.

Referring to FIG. 2, plate 10 is shown installed in a circular mounting hole 31 cut in dry wall 30 (although it could equally be mounted in a plaster wall or in a floor). Plate- 10 is shown pressed against the front side of wall 30 with brace 22 fitted inside the hole in wall 30. Arm 24 is shown extended outwardly to press against the backside of wall 30.

Referring to FIGS. 2, 3, 4, 5, and 6, brace 22 is shown as a circular annulus having six equiangularly spaced holes 23. Three of those holes are used to rotatably support arms 24. The length of arms 24 have a centerline whose radius of curvature matches that of brace 22. (Arm 24 is sometimes referred to as a curved flipper). The inner end of arm 24 has a hub 24A from which coaxial collar 24B extends. Collar 24B ends in a small flange. Collar 24B is sized to snap into one of the holes 23 in brace 22.

Brace 22 has a rearward internal ridge 22A that interlocks with an external forward ridge 26A on adaptor tube 26. Adaptor tube 26 (see also FIG. 8) has its ridge 26A interlocked with ridge 22A so that brace 22 can rotate coaxially around tube 26 for purposes to be described presently.

Adaptor tube 26 is shown in FIG. 2 with a tapered aft end sized to mate smoothly with elbow 28. Although an elbow is shown, in other embodiments a differently angled fitting or a straight pipe can connect to tube 26. There is no significant discontinuity at the junction between tube 26 and elbow 28 so that no turbulence is promoted and there is no cavity in which debris can accumulate. Similarly, the forward end of tube 26 is tapered inwardly to sealingly press against the outside of inlet tube 16. This again forms a good seal without the need for an O-ring. Tube 26 is preferably made of a resilient plastic or rubber, but other materials may be used that are appropriate for forming a tight seal while still allowing the tube to be glued to elbow 28.

Figure 9:
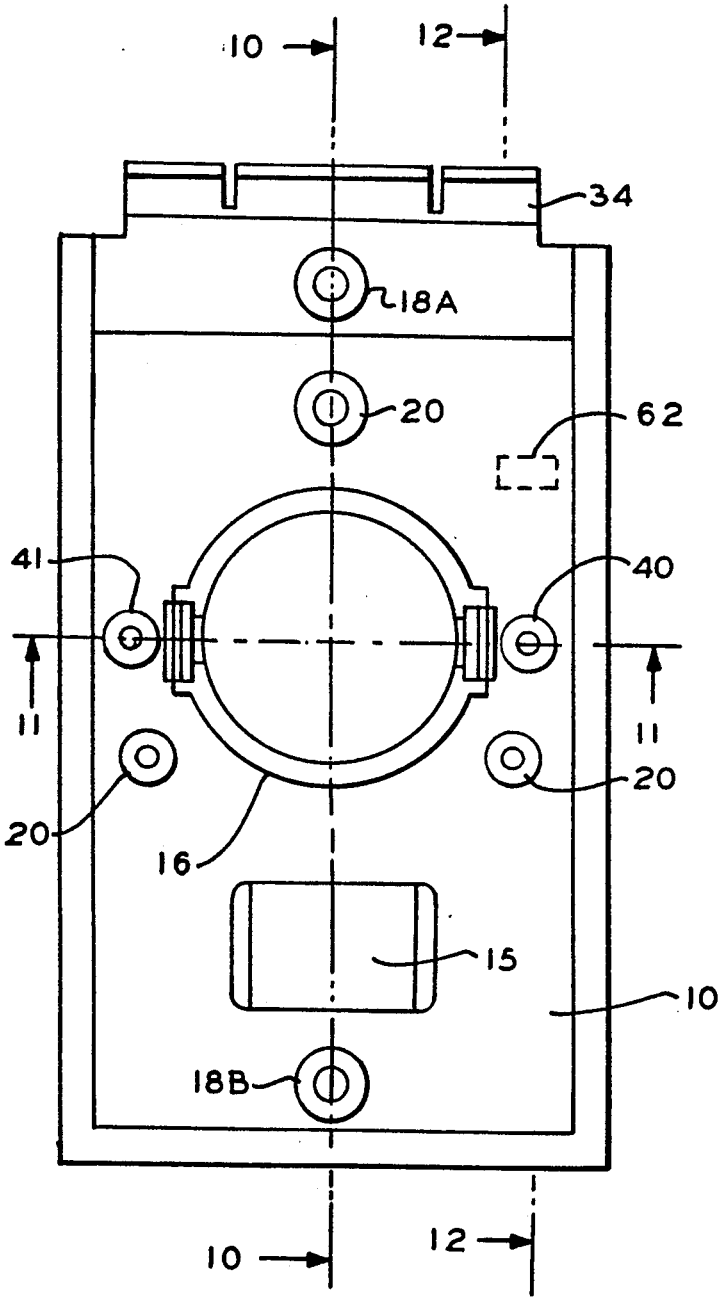
FIG. 9 is a rear view of the front mounting plate of FIG. 2.
Figure 10:
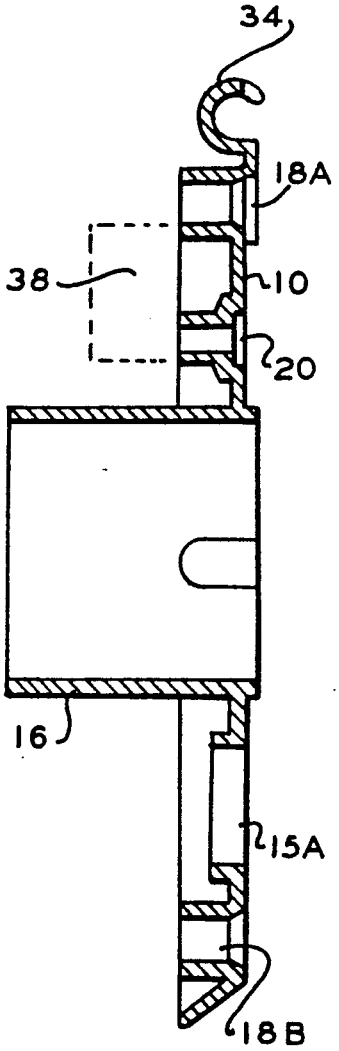
FIG. 10 is a cross sectional view of the mounting plate, taken along line 10—10 of FIG. 9.

Referring to FIGS. 2, 9, and 10, front mounting plate 10 is shown having a trough-shaped edge 34. Edge 34 is curled to receive a helical torsion spring 36, whose opposite ends bear against mounting plate 10 and door 12 to push the latter shut. The ends of hinge spring 36 fit into slots in door 12 and in edge 34.

A switch means 38 is shown mounted on the back of mounting plate 10. In this embodiment, switch means 38 is a microswitch having a actuator arm that is oriented to sense either the opening of the door or the insertion of a hose coupling into inlet 16. Microswitch 38 is useful for systems that employ a higher voltage such as house line voltage. Under these circumstances, high voltage contacts are isolated inside a switch case to prevent injury.

Referring to FIGS. 9 and 11, contact supports 40 and 41 are shown as screw hole embossments for supporting, for example, tube contact 42. As illustrated in FIG. 11, contact 42 has a U-shaped portion 42A that emerges through an aperture in mounting plate 10 to follow a tunnel 44 that leads to the interior of inlet tube 16. Tube contact 42 has a question mark shape and its tube end is dimpled to provide a contact surface. The opposite end of contact 42 is apertured to allow attachment to screw embossment 40 by means of screw 46.

Figure 12:
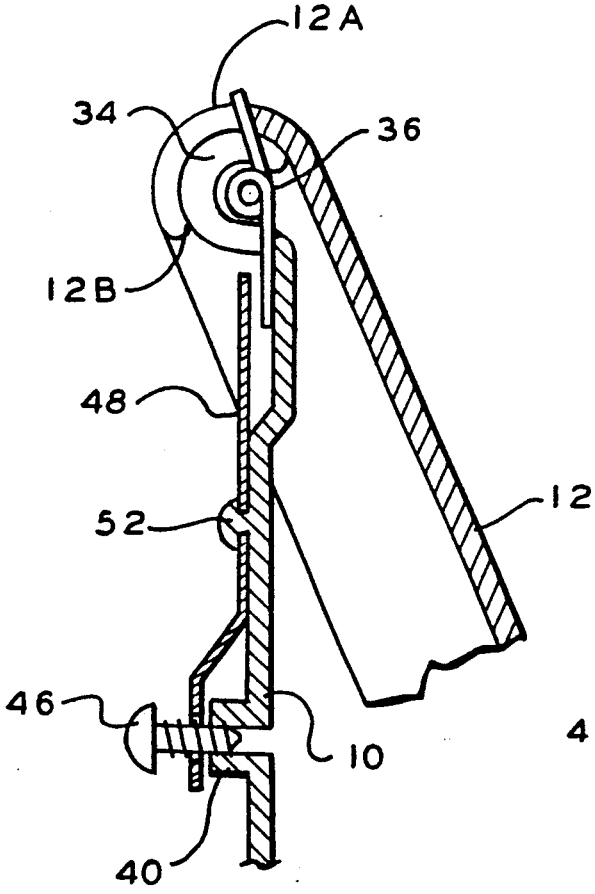
FIG. 12 is a cross sectional view of the front mounting plate with hardware and door attached, taken along line 12—12 of FIG. 9.

Referring to FIGS. 1, 9, and 12, door 12 is shown rotatably fitted by its curled, hinge edge 12A around trough-shaped edge 34. Hinge spring 36 is shown arranged to urge door 12 closed. In FIG. 1 a generalized switching means 48 is shown in phantom secured by screw 46 and extending upwardly for touching the end of hinge spring 36.

In FIG. 12, switching means 48 is shown as a cantilevered contact that can act as a lagging switch means. Contact 48 is a narrow metallic strip having a stepped and apertured end that is secured by means of screw 46 to previously mentioned contact support 40. The mid section of contact 48 is also apertured and is secured to boss 52. Boss 52 can initially be a rod-like projection molded to the back side of plate 10, so that the contact 48 can be fitted over boss 52 and its end peened by heat.

The cantilevered end of contact 48, remote from support 40, extends over one end of spring 36. The hinge end 12A of door 12 has an abutment 12B. When the door 12 is opened to an extreme position, abutment 12B presses contact 48 against the end of hinge spring 36 to make a connection between screw 46 and spring 36. As shown in FIG. 1, hinge 36 further connects to strip contact 54. Contact 54 is similarly mounted on a boss 56 and by a screw to a contact support (support 41 of FIG. 9). Accordingly, a short circuit is made between the two contact supports 40 and 41 when the door is fully opened.

Figure 13:
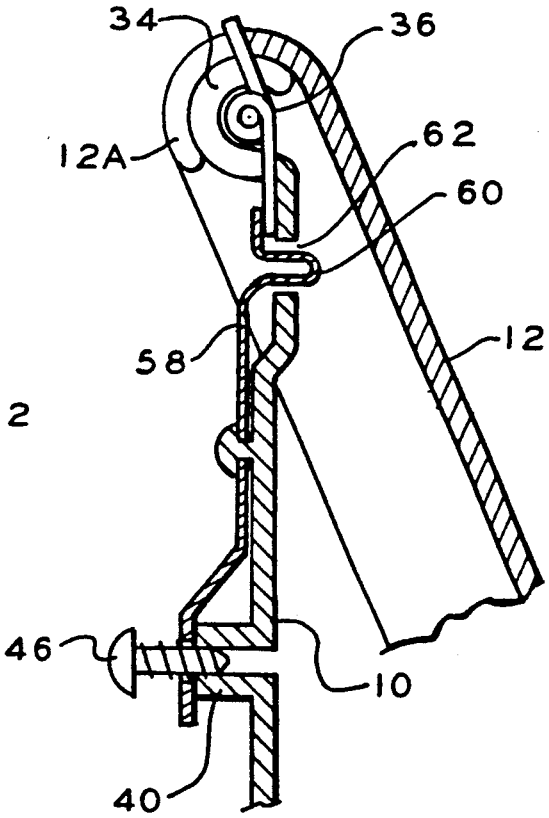
FIG. 13 is a cross sectional view of the apparatus of FIG. 12 but shown with alternate contacts installed.

Referring to FIGS. 9 and 13, the previously mentioned strip contact is replaced with leading cantilevered contact 58. Contact 58 is an elongated metallic strip having a kink 60. Contact 58 has a shape similar to the previous contact (contact 48 of FIG. 12) in that the end adjacent to contact support 40 is stepped and apertured for attachment by screw 50. The cantilevered end of contact 58 also reaches to the end of torsion spring 36 and is biased to press against it normally.

Kink 60 protrudes through hole 62 in mounting plate 10. Hole 62 can be the remains of a knock out panel or simply a hole punched with an appropriate tool. In the position shown in FIG. 3, contact 58 normally engages spring 36 so there is normally a short circuit between contacts supports 40 and 41 (FIG. 9). When door 12 is full closed, however, its inside surface engages kink 60 to deflect contact 58 rearwardly. This interrupts the short circuit.

To facilitate an understanding of the principles associated with the foregoing apparatus, its operation will now be briefly described. Before installation, the inlet valve must be configured to the appropriate electrical system. For example, systems requiring line voltage will require the removal of knockout panel 15 (FIG. 9) and the installation of a line voltage receptacle (not shown) to power at the remote end of the vacuum hose an accessory, such as a rug beater.

In other embodiments, there will be no line voltage receptacle and plate 10 will simply have tube contacts 42 as illustrated in FIG. 11. Plate 10 may be sold with tube contacts 42 installed. Alternatively, tube contacts 42 can be included as a separate kit element so contacts 42 can be inserted into tunnel 44 and through the hole in plate 10 alongside inlet tube 16 to make the configuration of FIG. 11. In other embodiments contacts 42 are unnecessary and may be removed or never installed.

In still other embodiments, a microswitch 38 (FIG. 10) can be mounted on the back of plate 10. Microswitch 10 can carry line voltage and will have an actuator arm (not shown) that extends through a hole in plate 10 (for example hole 62 of FIG. 9) to engage the door when closed. The closing of the door can open the microswitch to turn off the central vacuum system. Alternatively, the arm of the microswitch can be oriented to extend through an aperture (not shown) in inlet tubes 16 to close the switch when a hose coupling is inserted into tube 16.

In still other embodiments, cantilevered contact 48 (FIG. 12) or 58 (FIG. 13) may be installed on the back of plate 10 to create a short either when the door is first opened or when the door is opened to an extreme. In most embodiments, developing a short circuit between two points such as the contact supports 40 and 41 (FIG. 9) is sensed by the central vacuum system to operate a relay and start the central vacuum.

After the mounting plate has gotten the desired electrical configuration, the inlet valve assembly is installed. In new construction, a bracket can be nailed or otherwise secured to a stud and the plate 10 can be directly screwed to the bracket by means of screw holes 18A and 18B after the dry wall is installed.

For existing homes, a circular hole is cut in the wall or floor that is to receive the inlet valve. An advantage here is that the hole can be done with a circular drill, which operates quickly and cleanly. The hole is sized to allow entry of the annular brace 22 (see FIGS. 1 and 2). Plate 10 is initially connected to brace 22 by means of three screws 66 (FIG. 2) inserted through screw holes 20 (FIG. 1) connecting to the central bore in the collar 24B and hub 24A of arm 24 (FIG. 6). The valve assembly comes with adaptor tube 26 installed on annular brace 22 (FIG. 1) so they are locked together but rotate with respect to each other. Initially, the arms 24 are folded to a retracted position alongside brace 22, as shown for the upper arm in FIG. 5. When retracted, arms 24 do not obstruct the insertion of brace 22 into hole 31 (FIG. 2) of wall or floor 30.

Next, elbow 28 or another appropriate fitting can be glued directly to the rear of adaptor tube 26. Note that the angular orientation of tube 26 and fitting 28 is not critical since tube 26 can rotate within brace 22. Plate 10, brace 22, tube 26 and fitting 28 are now inserted through hole 31 (FIG. 2) in wall 30 approximately into the position shown in FIG. 2. When initially inserted, arms 24 are folded into a retracted position alongside brace 22. Next, screws 66 are turned to rotate hub 24A, extend the arms 24 outwardly and draw them against the back of wall 30. At this point, the mounting plate 10 is secure so it will not fall out of mounting hole 31.

In the usual fashion, central vacuum pipe 64 (FIG. 2) has glue applied to one end. The glued end of pipe 64 is then routed through the interior of the wall and is inserted into the fitting 28. The inlet valve is now connected. The angular orientation, however, of plate 10 may need adjustment. Specifically, plate 10 can be rotated to turn inlet tube 16 and brace 22. Adaptor tube 26 must remain stationary since pipe 64 holds the angular orientation of fitting 28 and tube 26. Plate 10 and brace 22 can still rotate since tube 26 can rotate within brace 22 and around tube 16. Accordingly, the angular orientation of mounting plate 10 can be set so the plate has the most visually acceptable orientation to the floor and wall elements of the room.

The inlet valve is then used by the owner in the usual way by first lifting door 12. Depending upon the configuration, the partial or extreme opening of door 12 creates a short circuit that starts the central vacuum. Alternatively, the door 12 is lifted without effect but the insertion of a hose coupling (not shown) into inlet tube 16 can short tube contacts 42 (FIG. 11) for embodiments having a metal hose coupling. In other embodiments, the hose coupling can have two semi-cylindrical halves that separately connect to the two spaced tube contacts 42 so that a switch at the remote end of the vacuum hose can short the contacts 42 and operate the central vacuum. In still other embodiments, a microswitch can be installed in the manner previously described so that opening of the door or insertion of a vacuum hose can operate the line voltage contacts of the microswitch.

Once the vacuum system is started the hose end can be used in the usual fashion (with optional rug beaters or other accessories powered through an optional power receptacle mounted in hole 15A). The vacuum draws dirt and other debris in the usual fashion through the hose and then through inlet tube 16, adaptor tube 26, elbow fitting 28, and pipe 64. The material thus vacuumed is carried to a central holding bag in the usual fashion.

It is to be appreciated that various modifications may be implemented with respect to the above described, preferred embodiments. For example, the number of arms on the annular brace can be greater or less in number, depending upon the desired strength, complexity, reliability, etc. Also, the brace preferably has a circular center opening but its outer periphery can be polygonal, oval, etc. Additionally, the connection between the adaptor tube and the annular brace can be accomplished by a tongue and groove, snap rings, threads, force fittings or other appropriate joints. Also, the arms on the annular brace can be attached by screws, rivets, pins, or other fastening means. Moreover, the shape and taper of the adaptor tube can be modified depending upon the desired strength, the need to reduce voids, and the desired sealing integrity. Furthermore, various shapes of electrical contacts can be employed and in some embodiments, the hinge spring will not be used as a connecting element. Also, the cantilevered springs can be supported by bosses or can be held in place by snap rivets, screws, or other fastening devices. Similarly, the cantilevering of the contacts can be accomplished by either a relief in the back side of the front mounting plate or by a jog or step in the contact. Also the tube contacts can be installed through holes in the front mounting plate or directly in holes in the side walls of the inlet tube. Furthermore the size and dimensions of the various components can be altered depending upon the desired strength, rigidity, and the size of the hose coupling to be accommodated by the inlet valve.

Obviously, many modifications and variations of the present invention are possible in light of the above teachings. It is therefore to be understood that within scope of the appended claims, the invention may be practiced otherwise than as specifically described.

I claim:

1. An inlet valve assembly for a central vacuum system to be installed in a wall or floor having a front side, a backside and a mounting hole extending therethrough, said inlet valve assembly comprising:

a front mounting plate having an inlet tube;

an annular brace adapted to slidably mount on said inlet tube and sized to fit through said mounting hole; and a plurality of clamping arms pivotally mounted on said brace, said arms being operable to swing from a retracted position alongside said brace to an extended position at said backside.

2. An inlet valve assembly according to claim 1 wherein said annular brace has a central opening, said clamping arms being mounted to swing about an axis that is transverse to said central opening.

3. An inlet valve assembly according to claim 2 wherein said brace comprises:

an annulus having an internal ridge ad supporting said clamping arms; and an adaptor tube rotatably mounted in said annulus, said adaptor tube having an external ridge for engaging said internal ridge of said annulus and preventing it from slipping off one end of said adaptor tube.

4. An inlet valve assembly according to claim 2 wherein said brace comprises:

an adaptor tube mounted at said central opening.

5. An inlet valve assembly according to claim 4 wherein said front mounting plate has a plurality of screw holes distributed in a pattern substantially the same as the axes of said clamping arms.

6. An inlet valve assembly according to claim 5 wherein each of said clamping arms comprises:

a curved flipper; and a collar mounted at one end of said flipper and rotatably mounted in said brace.

7. An inlet valve assembly according to claim 5 wherein said clamping arms are three in number.

8. An inlet valve assembly according to claim 4 wherein said adaptor tube is operable to rotate about its axis with respect to said clamping arms.

9. An inlet valve assembly according to claim 8 wherein said adaptor tube has at least one tapered end adapted to promote flow across the tapered end.

10. An inlet valve assembly according to claim 9 wherein said tapered end is relatively resilient to promote sealing and flow across the tapered end.

11. An inlet valve assembly according to claim 8 wherein said adaptor tube has two tapered ends adapted to promote flow there across.

12. An inlet valve assembly according to claim 8 wherein said brace comprises:

a circular annulus supporting said clamping arms.

13. An inlet valve assembly according to claim 12 wherein said clamping arms have substantially the same radius of curvature as said annulus.

14. An inlet valve assembly according to claim 13 said clamping arms have substantially the same radial thickness as said annulus.

15. An inlet valve assembly according to claim 8 wherein said front mounting plate has a knockout panel sized to support an electrical receptacle.

16. An inlet valve assembly according to claim 15 wherein said front mounting plate has a spaced pair of screw holes adapted to attach said front mounting plate to a bracket, so that for new construction said bracket can be mounted to a stud and so that said front mounting plate can be attached to said bracket after said stud is finished as an interior surface.

17. An inlet valve assembly according to claim 1 comprising:

a circumferentially spaced pair of tube contacts mounted on the rear of said front mounting plate to project from outside to inside said inlet tube.

18. An inlet valve assembly according to claim 17 wherein said inlet tube has an axially directed pair of peripheral tunnels communicating between the interior of said inlet tube and the front of said front mounting plate, said pair of tube contacts having a U-shaped portion separately projecting through said front mounting plate and into respective ones of said tunnels.

19. An inlet valve assembly according to claim 1 further comprising:

a door pivotally mounted on said front mounting plate to cover said inlet tube.

20. An inlet valve assembly according to claim 19 further comprising:

switching means mechanically actuated either by said door or insertion of said inlet tube.

21. An inlet valve assembly according to claim 19 comprising:

a cantilevered contact mounted on the rear of said front mounting plate to engage and be deflected by motion of said door.

22. An inlet valve assembly according to claim 21 wherein said cantilevered contact is adapted to be optionally mounted on said mounting plate.

23. An inlet valve assembly according to claim 19 wherein said front mounting plate is adapted to versatilely receive any one of the following:

(a) a leading cantilevered contact mounted on the rear of said front mounting plate to engage and be deflected by closing of said door;

(b) a lagging cantilevered contact mounted on the rear of said front mounting plate to engage and be deflected by opening of said door; and (c) a circumferentially spaced pair of tube contacts mounted on the rear of said front mounting plate to project from outside to inside said inlet tube.

24. An inlet valve assembly according to claim 23 further comprising:

a contact support- on the rear of said front mounting plate, said leading and lagging cantilevered contacts being interchangeably mountable on said contact support.

25. An inlet valve assembly according to claim 24 wherein said front mounting plate has a switching aperture and wherein said leading cantilevered contact is mounted on the rear of said front mounting plate and includes an elongated strip having a kink protruding through said switching aperture to engage said door.

26. An inlet valve assembly according to claim 24 wherein said lagging cantilevered contact is mounted on the rear of said front mounting plate and wherein said door has a hinge edge with an abutment positioned to deflect said lagging cantilevered contact.

27. An inlet valve assembly according to claim 24 comprising:

a hinge spring for urging closing of said door, said leading and said lagging cantilevered contacts being sized to touch said hinge spring, so that said hinge spring can act as an electrical connection.

28. An inlet valve assembly according to claim 27 wherein said front plate has a trough-shaped edge, said door having a concave hinge edge shaped to mate with said trough-shaped edge.

29. An inlet valve assembly according to claim 23 wherein said annular brace has a central opening and wherein said brace comprises:

an adaptor tube mounted at said central opening.

30. An inlet valve assembly according to claim 29 wherein said adaptor tube is operable to rotate about its axis with respect to said clamping arms.

31. An inlet valve assembly according to claim 30 wherein said adaptor tube has at least one tapered end adapted to promote flow across the tapered end.

32. An inlet valve assembly according to claim 31 wherein said brace comprises:

a circular annulus supporting said clamping arms.

33. An inlet valve assembly for a central vacuum system to be installed in a wall or floor having a front side, a backside and a mounting hole extending therethrough, said inlet valve assembly comprising:

a front mounting plate having an inlet tube;

a door pivotally mounted on said front mounting plate to cover said inlet tube, said front mounting plate being adapted to versatilely receive any one of the following:

(a) a switching means mounted on the rear of said front mounting plate to engage and be actuated by motion of said door; and (b) a circumferentially spaced pair of tube contact mounted on the rear of said front mounting plate to project from outside to inside said inlet tube.

34. An inlet valve assembly according to claim 33 wherein the front mounting plate is adapted to versatilely receive any one of the following:

(a) a leading switching means mounted on the rear of said front mounting plate to engage and be actuated by a partial opening of said door; and (b) a lagging switching means mounted don the rear of said font mounting plate to engage and be actuated by full opening of said door; and 35. An inlet valve assembly according to claim 34 wherein said leading switching means is mounted on the rear of said front mounting pale and comprises:

a leading cantilevered contact mounted on the rear of said front mounting plate to engage and be deflected by closing of said door.

36. An inlet valve assembly according to claim 35 wherein said front mounting plate has a switching aperture and wherein said leading cantilevered contact includes an elongated strip having a kink protruding through said switching aperture to engage said door.

37. An inlet valve assembly according to claim 34 wherein said lagging switching means is mounted on the rear of said front mounting plate and comprises:

a lagging cantilevered contact mounted on the rear of said front mounting plate to engage and be deflected by opening of said door.

38. An inlet valve assembly according to claim 37 wherein said door has a hinge edge with an abutment positioned to deflect said lagging cantilevered contact.

39. An inlet valve assembly according to claim 34 further comprising:

a contact support on the rear of said front mounting plate, said leading and lagging switching means being interchangeably mountable on said contact support.

40. An inlet valve assembly according to claim 39 comprising:

a hinge spring for urging closing of said door, said leading and said lagging switching means being operable to connect to said hinge spring, so that said hinge spring can act as an electrical connection.

41. An inlet valve assembly according to claim 40 wherein said front plate has a trough-shaped edge, said door having a concave hinge edge shaped to mate with said trough-shaped edge.

42. An inlet valve assembly according to claim 33 wherein said front mounting plate is adapted to versatilely receive any one of the following:

door switching means mechanically actuated by said door; and tube switching means mechanically actuated by insertion of said inlet tube.

43. An inlet valve assembly according to claim 33 further comprising:

an annular brace adapted to slidably mount on said inlet tube and sized to fit through said mounting hole; and a plurality of clamping arms pivotally mounted on said brace, said arms being operable to swing from a retracted position alongside said brace to an extended position at said backside.

44. An inlet valve assembly according to claim 43 wherein said annular brace has a central opening and wherein said brace comprises:

an adaptor tube mounted at said central opening.

45. An inlet valve assembly according to claim 44 wherein said adaptor tube is operable to rotate about its axis with respect to said clamping arms.

46. An inlet valve assembly according to claim 45 wherein said adaptor tube has at least one tapered end adapted to promote flow across the tapered end.

47. An inlet valve assembly according to claim 46 wherein said brace comprises:

a circular annulus supporting said clamping arms.

* * * * *